US007865370B2

(12) United States Patent
Cormack et al.

(10) Patent No.: US 7,865,370 B2
(45) **Date of Patent: *Jan. 4, 2011**

(54) CONTENT FILTERING FOR A DIGITAL AUDIO SIGNAL

(75) Inventors: Christopher J. Cormack, Hillisboro, OR (US); Tony Moy, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 202 days.

This patent is subject to a terminal disclaimer.

(21) Appl. No.: 12/275,893

(22) Filed: Nov. 21, 2008

(65) Prior Publication Data

US 2009/0083784 A1 Mar. 26, 2009

Related U.S. Application Data

(63) Continuation of application No. 10/854,888, filed on May 27, 2004, now Pat. No. 7,461,004.

(51) Int. Cl.
*G10L 19/00* (2006.01)

(52) U.S. Cl. ..... 704/500; 704/251; 704/278; 707/501.1

(58) Field of Classification Search ..... 704/500, 704/231, 251, 257, 270, 278; 707/501.1
See application file for complete search history.

(56) References Cited

U.S. PATENT DOCUMENTS

| | | | | |
|---|---|---|---|---|
| 6,076,059 | A | 6/2000 | Glickman et al. | |
| 7,013,273 | B2 | 3/2006 | Kahn | |
| 2002/0007371 | A1 * | 1/2002 | Bray | 707/501.1 |

* cited by examiner

*Primary Examiner*—Huyen X. Vo
(74) *Attorney, Agent, or Firm*—Buckley, Maschoff & Talwalkar LLC

(57) ABSTRACT

According to some embodiments, content filtering is provided for a digital audio signal.

18 Claims, 8 Drawing Sheets

CONTENT FILTERING FOR A DIGITAL AUDIO SIGNAL

CROSS REFERENCE TO RELATED APPLICATIONS

The present application is a continuation of U.S. patent application Ser. No. 10/854,888, filed May 2, 2004, and entitled "Content Filtering for a Digital Audio Signal".

BACKGROUND

A person may receive content, such as a television show, from a content provider. Moreover, in some cases a person will find a particular type of content objectionable. For example, a person might prefer to not hear certain words or phrases. It is known that a content provider may delete or "bleep out" content when many people would find the content objectionable. Such an approach, however, may be impractical for content that is provided in substantially real time (e.g., a live sporting event). In addition, it does not take into account the fact that one person might object to a particular word or phrase while another person does not.

DETAILED DESCRIPTION

Figure 1:
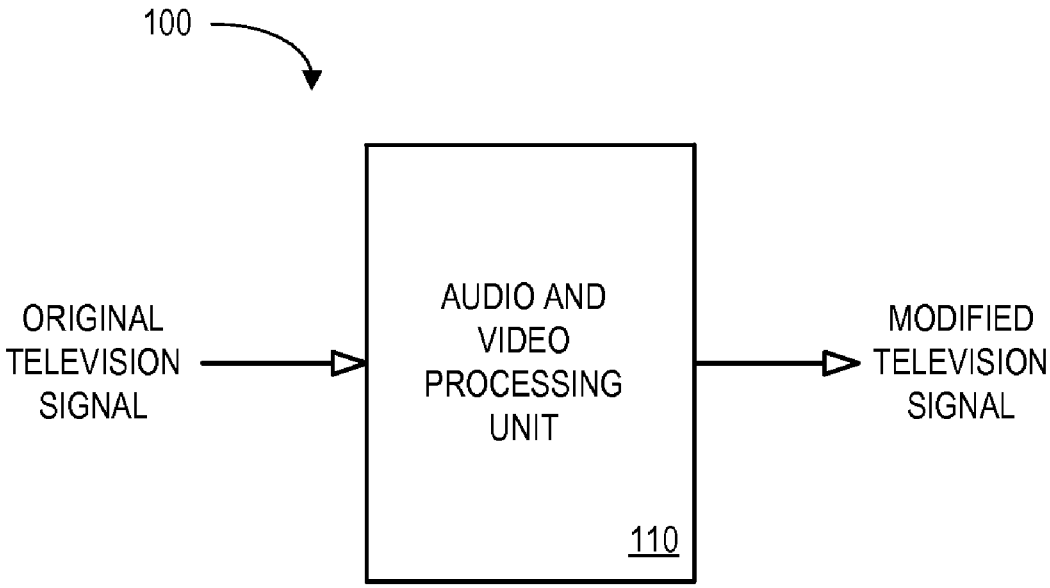
FIG. 1 is a block diagram of a system according to some embodiments.

A person may receive content, such as a television show, from a content provider. For example, FIG. 1 is a block diagram of a system 100 according to some embodiments. In particular, an audio and video processing unit 110 receives an original television signal. By way of example, the audio and video processing unit 110 might comprise, or be associated with, a television, a Personal Computer (PC), and/or a set-top box. The television signal might be received, for example, from a cable or satellite television service.

As used herein, the phrase "television signal" may refer to any signal that provides audio and video information. A television signal might, for example, be a Digital Television (DTV) signal associated with the Motion Picture Experts Group (MPEG) 1 protocol as defined by International Organization for Standardization (ISO)/International Engineering Consortium (IEC) document number 11172-1 entitled "Information Technology—Coding of Moving Pictures and Associated Audio for Digital Storage Media" (1993). Similarly, a television signal may be a High Definition Television (HDTV) signal formatted in accordance with the MPEG4 protocol as defined by ISO/IEC document number 14496-1 entitled "Information Technology—Coding of Audio-Visual Objects" (2001). As still another example, the television signal might be received from a storage device such a Video Cassette Recorder (VCR) or a Digital Video Disk (DVD) player in accordance with the MPEG2 protocol as defined by ISO/IEC document number 13818-1 entitled "Information Technology—Generic Coding of Moving Pictures and Associated Audio Information" (2000).

According to some embodiments, the audio and video processing unit 110 alters the original television signal and provides a modified television signal (e.g., to be played for a viewer). For example, audio information associated with certain words or phrases might be deleted and replaced with silence or another sound.

Figure 2:
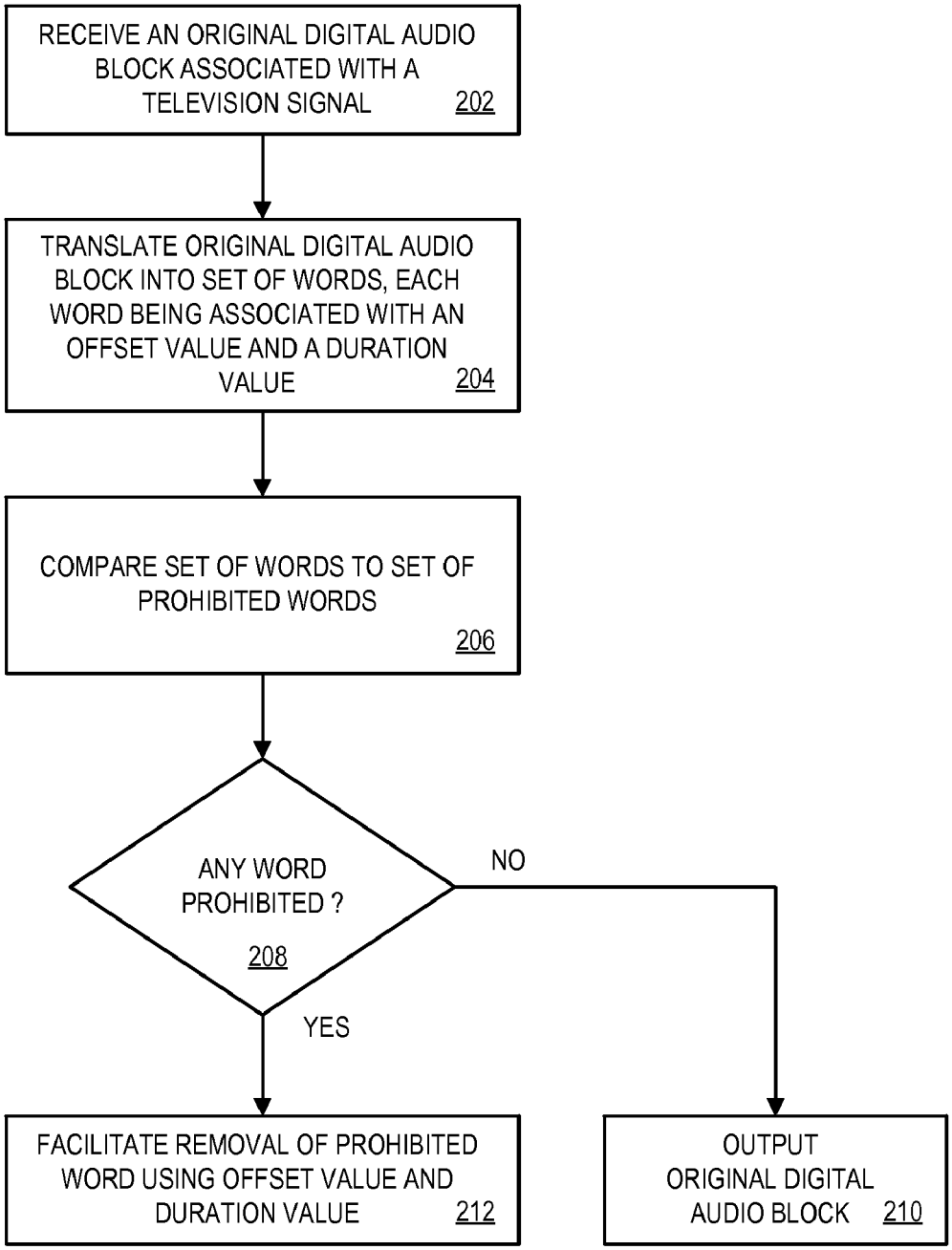
FIG. 2 is a flow chart of a method according to some embodiments.

FIG. 2 is a flow chart of a method according to some embodiments. The method may be performed, for example, by the audio and video processing unit 110. The flow charts described herein do not necessarily imply a fixed order to the actions, and embodiments may be performed in any order that is practicable. Note that any of the methods described herein may be performed by hardware, software (including microcode), firmware, or any combination of these approaches. For example, a storage medium may store thereon instructions that when executed by a machine result in performance according to any of the embodiments described herein.

At 202, an original digital audio block associated with a television signal is received. For example, a tuner and/or an audio decoder might generate a series of digital audio blocks based on an HDTV signal. According to other embodiments, an analog audio signal is received and then converted into a series of digital audio blocks.

At 204, the original digital audio block is translated into a set of words. For example, a processor might execute a speech-to-text conversion function (e.g., voice recognition) on the original digital audio block and generate text that represents the words that are included in that block. Moreover, each word may be associated with an offset value and a duration value. The offset value may represent, for example, a period of time between the beginning of the block and the beginning of the word (e.g., the word begins 1.5 seconds after the beginning of the block). As another example, the offset value may represent a time period between the beginning of the word and another known event (e.g., the beginning of a television show). The duration value may represent, for example, how long the word lasts (e.g., the word lasts 0.5 seconds).

At 206, the translated words are compared to a set of prohibited words. For example, a database might contain a list of prohibited words. In this case, each word in the original digital audio block might be compared to the database to determine whether or not that particular word is prohibited. As another approach, a database might include a list of allowed words (and any word not on the allowed list would be prohibited).

If it is determined that none of the translated words were included in the set of prohibited words at 208, the original digital audio block is output at 210. For example, the original digital audio block might be transmitted to an audio device (e.g., a speaker) and, ultimately, played for a viewer.

If it is determined that at least one of the words was prohibited at 208, removal of the prohibited word is facilitated at 212. In particular, the offset value and the duration value associated with each prohibited word may be used to create a modified digital audio block. For example, a portion of the original digital audio block might be replaced with a number of consecutive replacement portions (e.g., each replacement portion representing silence) based on the offset value and the time value. The modified digital audio block may then be transmitted to an audio device.

Figure 3:
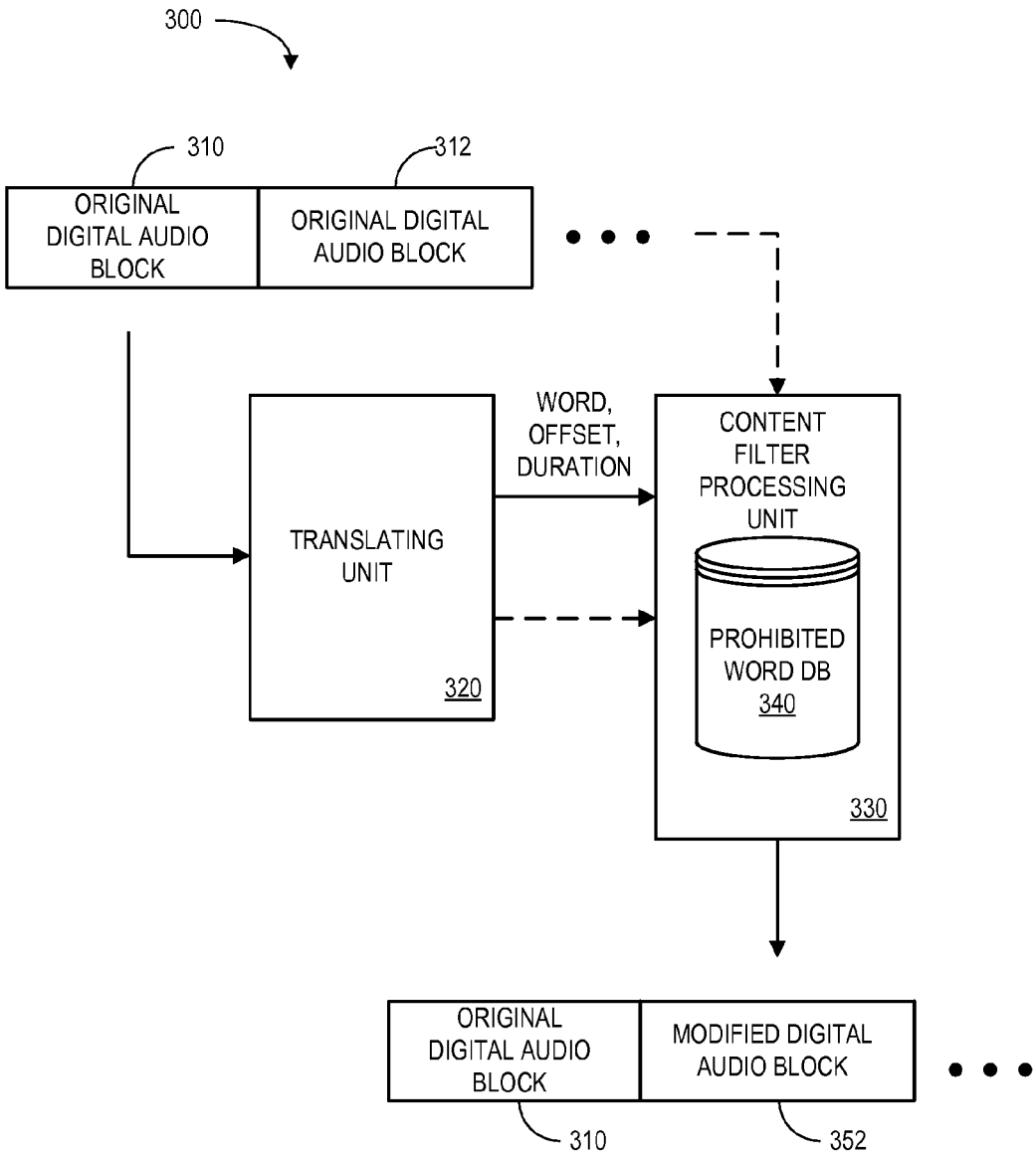
FIG. 3 is a block diagram of a system according to some embodiments.

FIG. 3 is a block diagram of a system 300 in which a stream of original digital audio blocks 310, 312 are provided to a translating unit 320 via an input line. The translating unit 320 may comprise, for example, a processor programmed to convert the original digital audio blocks 310, 312 into a set of words, each word being associated with an offset value and a duration value. The word text, offset value, and duration value are then provided to a content filter processing unit 330. Although separate devices are illustrated in FIG. 3, according to some embodiments the translating unit 320 and the content filter processing unit 330 are incorporated in a single device (e.g., a single processor).

As illustrated in Table I, the translating unit 320 might transmit the following information to the content filter processing unit 330:

TABLE I

Information Generated By Translating Unit

| Block ID | Word ID | Word Text | Offset Value | Duration Value |
|---|---|---|---|---|
| B001 | W01 | THIS | 0.50 | 0.50 |
| B001 | W02 | IS | 1.25 | 0.20 |
| B001 | W03 | AN | 1.50 | 0.20 |
| B001 | W04 | EXAMPLE | 1.75 | 0.90 |

In this case, the digital audio block B001 includes four words, and the fourth word (i.e., "EXAMPLE") begins 1.75 seconds after the beginning of the block and lasts for 0.90 seconds. According to another embodiment, the offset value instead represents a period of time from the end of the last word in the block.

The content filter processing unit 330 includes a prohibited word database 340. The prohibited word database 340 might simply be, for example, a list of words that a viewer would prefer not to hear. The content filter processing unit 330 can then compare each word received from the translating unit 320 with the words in the prohibited word database 340.

Consider, for example, the first digital audio block 310. In this case, the block 310 did not include any prohibited words—and the content filter processing unit 330 simply outputs the original block 310. Note that, as illustrated by dashed arrows in FIG. 3, the content filter processing unit 330 might receive the original digital audio block 310 from the translating unit 320 or from another device (e.g., an audio decoder).

Consider now the second digital audio block 312. In this case, the content filter processing unit 330 determined that one of the words received from the translating unit 320 is prohibited. As a result, the audio portion of the block 312 associated with that word is altered (e.g., based on the offset value and the duration value of that word) to create a modified digital audio block 352. By way of example, the original audio might be replaced with silence or a constant tone.

Figure 4:
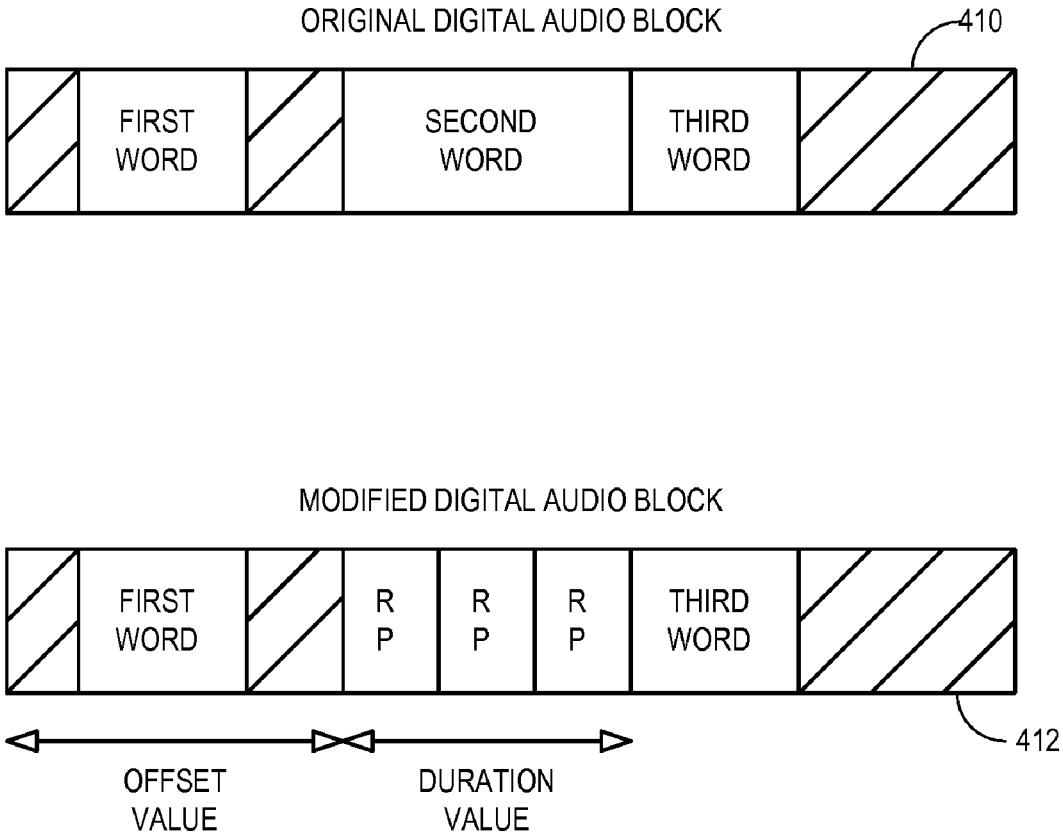
FIG. 4 illustrates digital audio blocks according to some embodiments.

FIG. 4 illustrates digital audio blocks according to some embodiments. In particular, an original digital audio block 410 contains three words, and the second word is included in a prohibited word database 340. As a result, that portion of the audio information is altered to create a modified digital audio block 412 that can be played for a viewer. In particular, the audio information starting at the offset value and ending at the offset value plus the duration value has been replaced with a number of consecutive Replacement Portions (RP), each replacement portion having a pre-defined duration. By way of example, a replacement portion might represent 0.1 seconds of silence. According to some embodiments, the number of replacement portions substantially equals the duration value divided by the duration of a single replacement portion. Moreover, additional replacement portions might be added before and/or after the ones illustrated in FIG. 4.

Figure 5:
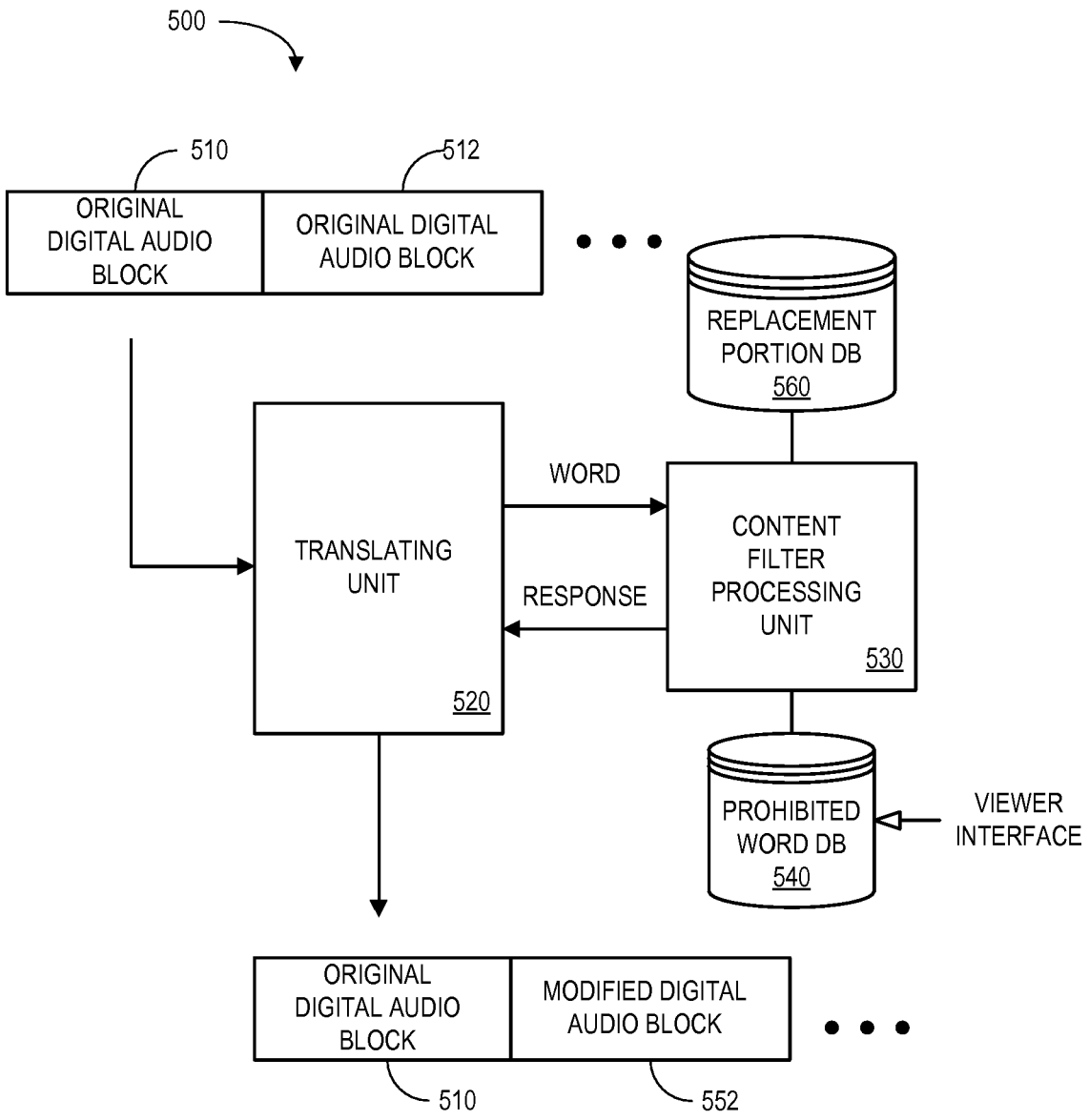
FIG. 5 is a block diagram of a system according to another embodiment.

FIG. 5 is a block diagram of a system 500 according to another embodiment. As before, a stream of original digital audio blocks 510, 512 are provided to a translating unit 520 which converts the blocks 510, 512 into a set of words. In this case, the text of the word is transmitted to a content filter processing unit 530 which is able to access a prohibited word database 540. The content filter processing unit 530 then returns a response for that particular word (e.g., with a "1" indicating that the word was found in the database 540 and a "0" indicating that it was not).

The translating unit 520 can then use the response and output either the original digital audio block 510 (e.g., when a "0" was received from the content filter processing unit 530) or a modified digital audio block 552 (e.g., when a "1" was received from the content filter processing unit 530). Note that in this case, the translating unit 520 may use the offset value and/or duration value associated with the prohibited word in order to create the modified digital audio block 552.

The information in the prohibited word database 540 might be generated in any number of ways. For example, a set-top box could use a pre-defined database and/or a database that is received from a remote device via a network (e.g., from a cable television service). According to some embodiments, a viewer may enter and/or adjust information in the prohibited word database 540. For example, a user might enter or remove a particular word, select a content category (e.g., indicating that violent words should be prohibited), and/or select a content level (e.g., indicating that even mildly objectionable words should be prohibited) via a Graphical User Interface (GUI) and/or a remote control device. According to some embodiments, a log of words that have been deleted or altered is stored (e.g., and may be used by a viewer to change the database 540).

According to some embodiments, different lists of prohibited words are maintained for different viewers and/or different times of day. For example, a parent might create a second list of objectionable words that should be used when a child is viewing content (e.g., and the appropriate list might be selected based on a viewer access code). As another example, a different list of prohibited words might automatically be used before and after 9:00 PM. As still another example, a list of prohibited words might depend on a content provider (e.g., the list might not be used at all when a viewer is watching a science channel). As yet another example, the list of prohibited words might depend on a rating. For example, a first list of words might be used for a show having a "TV-Y7" rating and a second list might be used for a show having a "TV-MA" rating as established by the National Association of Broadcasters, the National Cable Television Association, and the Motion Picture Association of America.

As used herein, the "words" in the prohibited word database 540 may comprise any language word or other sound that might be objectionable to a viewer. By way of example, the translating unit 520 might indicate that the sound of a scream, gunshot, or explosion has been identified in an original digital audio block. In addition, a word might actually be a combination of words. For example, a first word might only be prohibited when used in connection with a second word.

Moreover, according to embodiment, the translating unit 520 and/or content filter processing unit 530 might select a replacement sound from a replacement portion database 560

(e.g., the appropriate replacement portion might be included in the response transmitted from the content filter processing unit 530 to the translating unit 520). The appropriate replacement portion might be based, for example, on a viewer preference or the prohibited word that was identified (e.g., the replacement portion might be audio information that represents the word "heck" or "darn").

Figure 6:
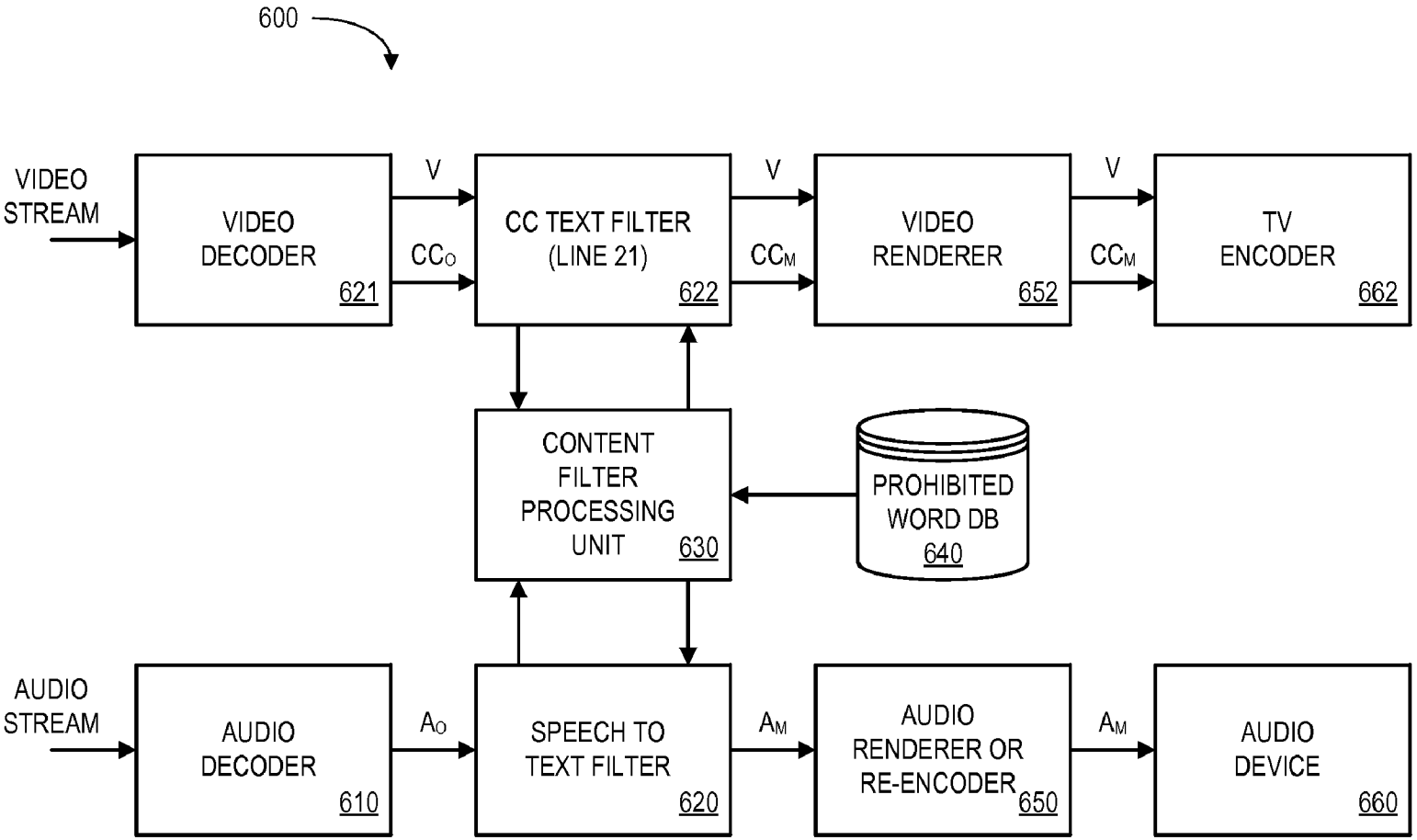
FIG. 6 is a block diagram of a system according to some embodiments.

FIG. 6 is a block diagram of a system 600 according to some embodiments. In this case, an audio decoder 610 receives a raw audio stream and generates blocks of original audio information $A_O$. The original audio information is provided to a speech-to-text filter 620 which sends a list of words to a content filter processing unit 630. The content filter processing unit 630 determines if any of the words are in a prohibited word database 640, and modified audio information $A_M$ is provided to an audio renderer or re-encoder 650 as appropriate. The modified audio signal $A_M$ may then be provided to an audio device 660 (e.g., a speaker, an audio receiver, a television, or PC sound card).

Figure 7:
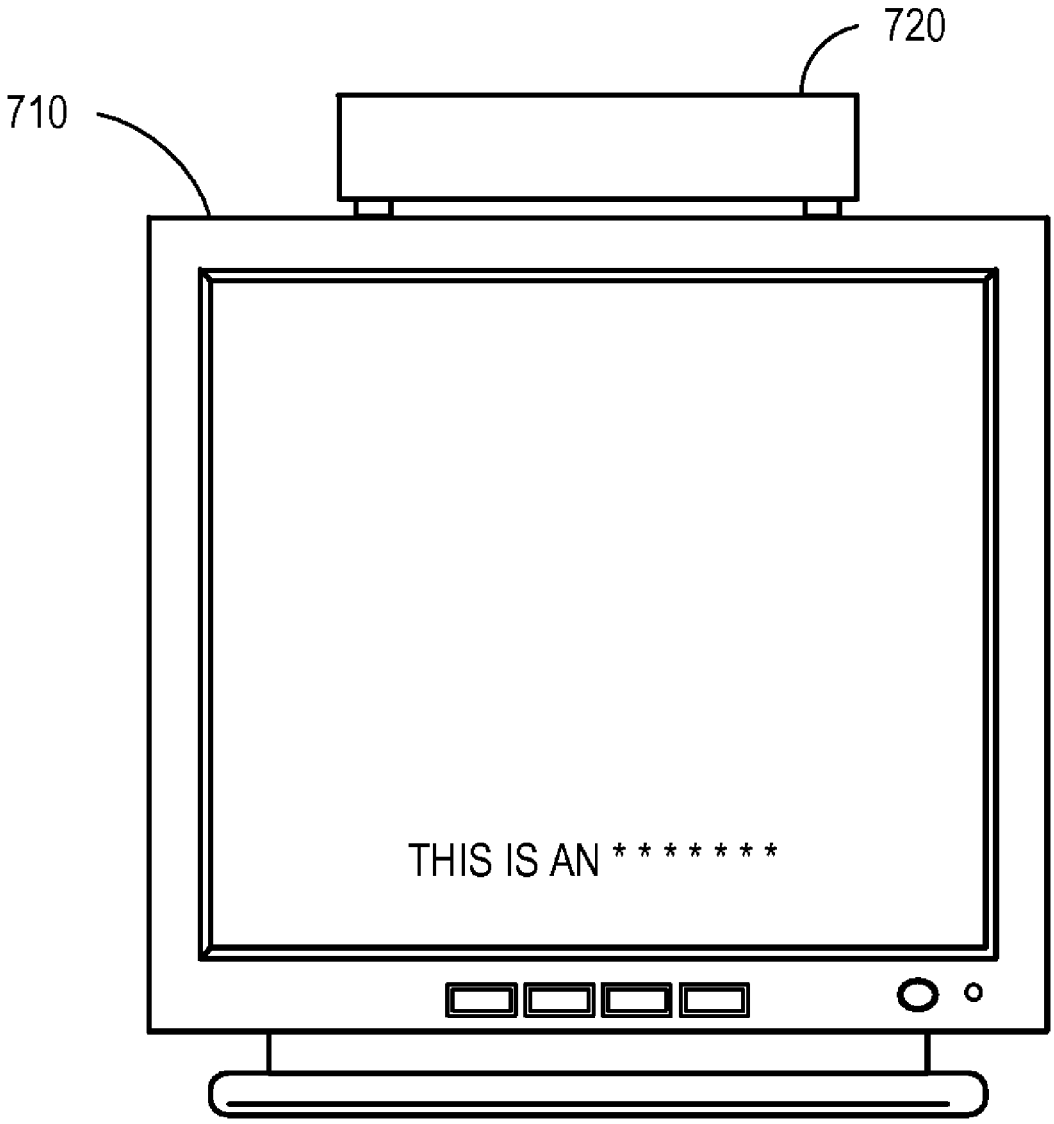
FIG. 7 illustrates a content filtered close-captioned display according to some embodiments.

The system also includes a video decoder 621 that receives a video stream. The video decoder then provides video information V and original close-captioned text $CC_O$ to a close-captioned text filter 622. The text $CC_O$ may be, for example, extracted from line 21 of the received video stream's Vertical Blanking Interval (VBI). According to this embodiment, the text $CC_O$ is also provided to the content filter processing unit 630 which can then determine whether or not any of the words are included in the prohibited word database 640. A modified close-captioned text $CC_M$ is then provided to a TV encoder 662 via a video renderer 652. For example, characters associated with prohibited words might be replaced with replacement characters. FIG. 7 illustrates a content filtered close-captioned display according to some embodiments. In this case, a set-top box 720 has used "*" as replacement characters in closed-caption text information displayed on a television 710. According to other embodiments, text may instead be deleted or replaced with other words (e.g., "heck" or "dam").

Referring again to FIG. 6, the content filter processing unit 630 might use audio information to adjust the closed-caption information and/or video information. For example, when a prohibited word is detected in the audio information, closed-caption text in a five second window around the word might be suppressed. As another example, the video signal might be blanked for a period of time (e.g., a pre-determined period of time or a period of time based on the duration value). Similarly, information in the closed-caption text could be used to suppress or replace audio information as appropriate.

Figure 8:
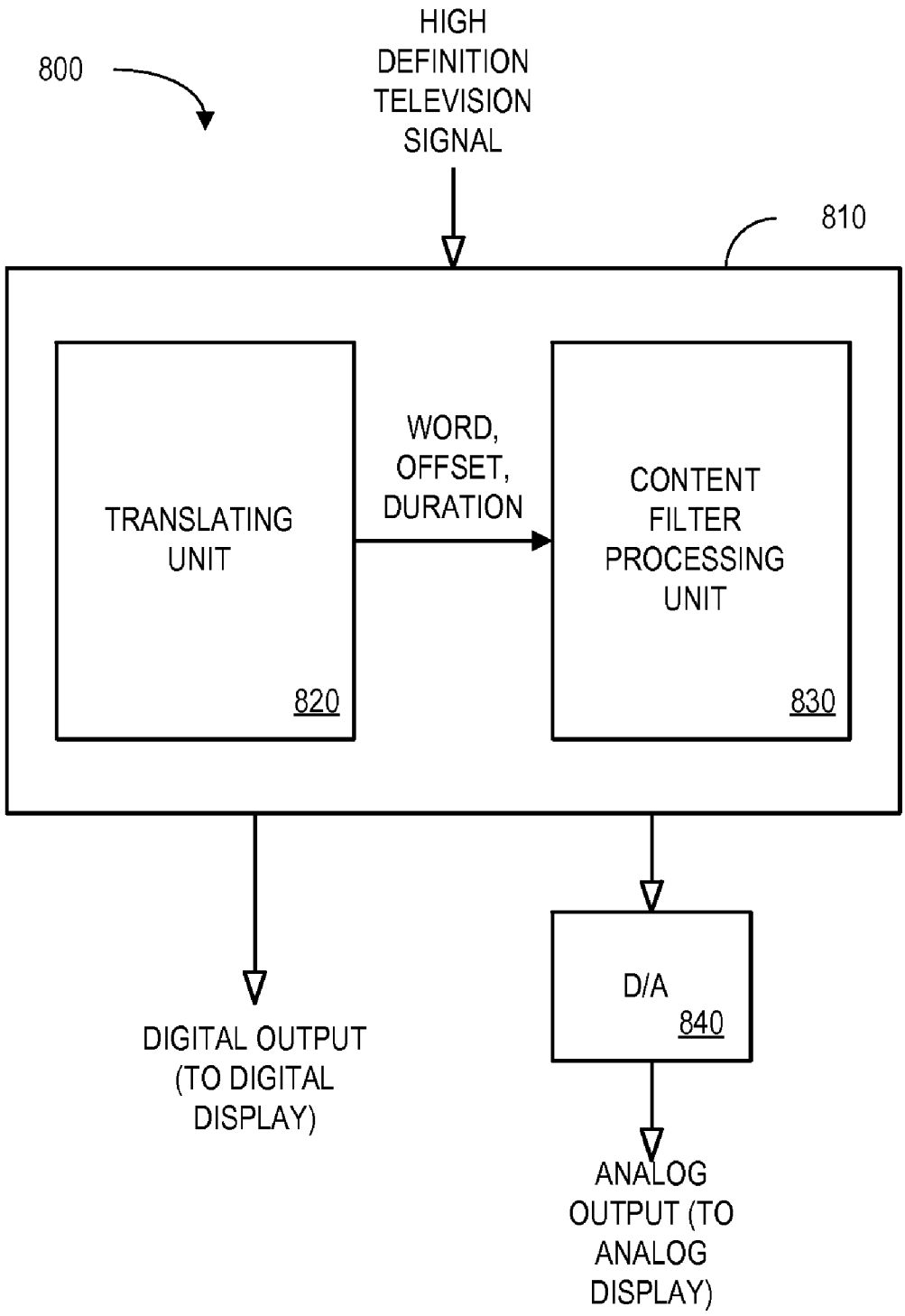
FIG. 8 is a block diagram of a system according to some embodiments.

FIG. 8 is a block diagram of a system 800 according to some embodiments. In particular, a video receiver 810 receives an HDTV signal. The video receiver 810 may be associated with, for example, a television, a set-top box, a PC, a portable device, a wireless device, a media player or storage device, and/or a game device.

Moreover, the video receiver 810 may operate in accordance with any of the embodiments described herein. For example, a translating unit 820 might convert an original digital audio block into a set of words, each word being associated with an offset value and a duration value. In addition, a content filter processing unit may (i) determine that at least one of the words is included in a set of prohibited words and (ii) facilitate removal of the prohibited word from the original digital audio block using the offset value and the duration value.

The system 800 may also include a digital output to provide a digital output signal (e.g., to a digital television). Moreover, according to some embodiments, the system 800 further includes a Digital-to-Analog (D/A) converter 840 to provide an analog output signal. The analog signal might be provided to, for example, an analog television or a VCR device. The digital and/or analog outputs may include modified audio and/or video information.

The following illustrates various additional embodiments. These do not constitute a definition of all possible embodiments, and those skilled in the art will understand that many other embodiments are possible. Further, although the following embodiments are briefly described for clarity, those skilled in the art will understand how to make any changes, if necessary, to the above description to accommodate these and other embodiments and applications.

Although some embodiments have been described with respect to television signals, according to other embodiments a content filter processing unit may instead be provided in a stereo, radio, or portable music device. For example, a portable music device adapted to play music in accordance with the MPEG1 audio layer 3 (MP3) standard might remove objectionable lyrics from music. As another example, such a filter might be used to remove certain words from a game system or PC (e.g., information received via the Internet).

Moreover, although some embodiments have been described with respect to a video receiver, according to other embodiments a video server instead includes a content filter processing unit. For example, a cable television service might include such a filter. As another example, such a filter might used when a television show is transmitted in substantially real-time (e.g., a live sporting event).

In addition, according to other embodiments each prohibited word is associated with an offset value, but not a duration value. For example, all audio information in a four second window around a prohibited word's offset value might be suppressed. As another example, an entire audio block might be suppressed.

The several embodiments described herein are solely for the purpose of illustration. Persons skilled in the art will recognize from this description other embodiments may be practiced with modifications and alterations limited only by the claims.

What is claimed is:

1. A method, comprising:

receiving an original digital audio block associated with a television signal and one of a plurality of content providers;

translating the original digital audio block into a set of words;

determining that at least one of the words is included in a set of prohibited words, wherein determining is based on the one of a plurality of content providers, and wherein each of plurality of content providers is associated with a respective set of prohibited words; and facilitating removal of the prohibited word from the original digital audio block, wherein said facilitating includes, replacing, by a processor, a portion of the original digital audio block with a plurality of consecutive replacement portions, each replacement portion having a pre-defined duration and the number of replacement portions being based on the duration value, to create a modified digital audio block.

2. The method of claim 1, wherein the television signal is a high definition television signal and the original digital audio block is received from an audio decoder.

3. The method of claim 1, wherein said translating includes processing the original digital audio block to generate text and said determining includes comparing the text to the set of prohibited words.

4. The method of claim 1, further comprising:

providing the modified digital audio block to an audio device.

5. The method of claim 4, wherein the audio device is one of: (i) an audio renderer, (ii) an audio re-encoder, (iii) a sound card, (iv) an audio receiver, or (v) a television device.

6. The method of claim 1, further comprising:

receiving close-captioned text information;

comparing the close-captioned text information with the set of prohibited words; and replacing characters in the close-captioned text information with replacement characters.

7. The method of claim 6, wherein the replacement characters comprise one of:

(i) a pre-defined character, (ii) deleted characters, or (iii) a replacement word.

8. The method of claim 1, further comprising:

receiving from a user an indication associated with a prohibited word.

9. The method of claim 8, wherein the indication is associated with at least one of: (i) a content category, (ii) a content level, (iii) a graphical user interface, or (iv) a remote device.

10. The method of claim 1, further comprising:

converting a received analog audio signal into the original digital audio block.

11. The method of claim 1, wherein the list of prohibited words is associated with at least one of: (i) a viewer, (ii) a content provider, (iii) a time, or (iv) a rating.

12. A non-transitory computer-readable storage device storing instructions adapted to be executed by a processor to perform a method to facilitate content filtering for a digital audio signal, said method comprising:

receiving by the processor an original digital audio block associated with a television signal and one of a plurality of content providers;

translating, by the processor, the original digital audio block into a set of words;

determining, by the processor that at least one of the words is included in a set of prohibited words, wherein the determining is based on the one of a plurality of content providers, and wherein each of plurality of content providers is associated with a respective set of prohibited words; and automatically facilitating removal of the prohibited word from the original digital audio block, by the processor, wherein said facilitating includes replacing a portion of the original digital audio block with a plurality of consecutive replacement portions, each replacement portion having a pre-defined duration and the number of replacement portions being based on the duration value, to create a modified digital audio block.

13. The article of claim 12, wherein the television signal is a high definition television signal and the original digital audio block is received from an audio decoder.

14. The article of claim 12, wherein said translating includes processing the original digital audio block to generate text and said determining includes comparing the text to the set of prohibited words.

15. An apparatus, comprising:

an input line to receive an original digital audio block associated with a television signal and one of a plurality of content providers;

a translating unit to convert the original digital audio block into a set of words; and a content filter processing unit to (i) determine, by a processor, that at least one of the words is included in a set of prohibited words, wherein the determining is based on the one of a plurality of content providers, and wherein each of plurality of content providers is associated with a respective set of prohibited words and (ii) facilitate removal of the prohibited word from the original digital audio block, wherein said removal includes replacing a portion of the original digital audio block with a plurality of consecutive replacement portions, each replacement portion having a pre-defined duration and the number of replacement portions being based on the duration value, to create a modified digital audio block.

16. The apparatus of claim 15, further comprising:

an audio decoder to convert a received audio stream into the original digital audio block.

17. The apparatus of claim 15, further comprising:

an audio device to receive a modified digital audio block including the plurality of consecutive replacement portions.

18. The apparatus of claim 15, wherein the apparatus is associated with at least one of: (i) a television, (ii) a set-top box, (iii) a personal computer, (iv) a portable device, (v) a wireless device, (vi) a media player, or (vii) a game device.

* * * * *